US006848438B2

(12) United States Patent
Celerier et al.

(10) Patent No.: US 6,848,438 B2
(45) Date of Patent: Feb. 1, 2005

(54) INTERNAL COMBUSTION ENGINE EXHAUST DEVICE AND METHOD FOR MAKING SAME

(75) Inventors: Daniel Celerier, Herblay (FR); Patrick Francois Markiewski, Elancourt (FR); Alain Pierdet, Rosny sous Bois (FR)

(73) Assignee: Renault, Boulogne Billancourt (FR)

( * ) Notice: Subject to any disclaimer, the term of this patent is extended or adjusted under 35 U.S.C. 154(b) by 0 days.

(21) Appl. No.: 09/402,472

(22) PCT Filed: Apr. 10, 1998

(86) PCT No.: PCT/FR98/00728

§ 371 (c)(1),
(2), (4) Date: Nov. 30, 1998

(87) PCT Pub. No.: WO98/45584

PCT Pub. Date: Oct. 15, 1998

(65) Prior Publication Data

US 2001/0025419 A1 Oct. 4, 2001

(30) Foreign Application Priority Data

Apr. 10, 1997 (FR) ..... 97 04411

(51) Int. Cl.[7] ..... B23P 17/00; F02D 41/00

(52) U.S. Cl. ..... 123/672; 29/890.08; 72/71; 123/703

(58) Field of Search ..... 123/672, 703, 123/676, 677, 679; 29/890.08; 72/71, 112, 479; 138/177, 37; 204/410, 428; 60/276, 322

(56) References Cited

U.S. PATENT DOCUMENTS 1,906,953 A * 5/1933 Enghauser ..... 29/890.08
2,991,551 A * 7/1961 Fogle et al. ..... 72/71
3,429,171 A * 2/1969 Feher ..... 72/377
3,874,171 A 4/1975 Schmidt et al.
3,939,683 A * 2/1976 van Geffen ..... 72/71
4,063,897 A * 12/1977 Aoki ..... 204/428
4,177,659 A * 12/1979 van Geffen ..... 72/71
4,185,486 A * 1/1980 Van Geffen ..... 72/71
4,362,605 A * 12/1982 Bozon et al. ..... 204/428
4,428,214 A * 1/1984 Head, Jr. et al. ..... 72/71
4,437,971 A * 3/1984 Csanitz et al. ..... 204/428
4,526,672 A * 7/1985 Reed ..... 204/428
4,617,795 A * 10/1986 Abthoff et al. ..... 204/410
5,331,810 A * 7/1994 Ingermann et al. ..... 60/322
5,571,397 A * 11/1996 Weber ..... 204/428
5,711,863 A * 1/1998 Henkelmann et al. ..... 204/428
5,832,723 A * 11/1998 Iwata et al. ..... 60/276
5,984,138 A * 11/1999 Olson ..... 220/801

FOREIGN PATENT DOCUMENTS

DE 42 24 131 A1 * 1/1994
FR 2 586 753 A1 * 1/1994
GB 2227536 A * 1/1990

* cited by examiner

*Primary Examiner*—Marc Jimenez
(74) *Attorney, Agent, or Firm*—Oblon, Spivak, McClelland, Maier & Neustadt, P.C.

(57) ABSTRACT

An internal combustion engine exhaust device. The device includes a conduit element through which exhaust gases flow. The conduit element includes a housing for mounting a measurement sensor such as an oxygen probe. The housing is formed by a hole extended by an insert produced directly through the conduit element.

10 Claims, 2 Drawing Sheets

INTERNAL COMBUSTION ENGINE EXHAUST DEVICE AND METHOD FOR MAKING SAME

BACKGROUND OF THE INVENTION

1. Field of the Invention

The present invention has as its object an exhaust device for internal combustion engines, and a process for manufacturing same. The present invention relates more particularly to an exhaust pipe provided with a housing suitable for mounting a measuring sensor and to the process for making such a housing.

2. Discussion of the Invention

The modern internal combustion engines of motor vehicles are equipped with an electronic control system which adjusts the quantity of fuel injected, the quantity of exhaust gas recirculated, etc. on the basis of preprogrammed strategies and as a function of engine operating conditions.

Among the items of information required by the electronic control systems in order to determine the operating conditions and consequently to adapt the quantity of fuel injected (the degree of opening of the EGR valve, etc.) there are included those relating to the composition and/or to the temperature of the exhaust gases and more particularly to the residual oxygen concentration. These items of information relating to the exhaust gases are delivered by appropriate measuring sensors, which are disposed along the path of the exhaust gases.

In the standard case, the measuring sensors with which the exhaust line is equipped are screwed into internally threaded housings traversing the wall of the exhaust pipes, in such a way as to bring the analysis cells into contact with the flow of exhaust gases.

In view of the slight thickness of the walls of the exhaust pipes in current use (between 1.5 and 2 mm on average) relative to the diameters of the holes to be made (more than 20 mm), the internally threaded holes in the standard case are formed by appropriate rings which are attached by welding in openings made through the exhaust pipes (SEFG welding or resistance welding).

It became apparent to the Applicant that reliance on welded rings suffers from disadvantages, and in particular from a large percentage of defects in assembly and leak-tightness. In fact, the heating during welding tends to deform the internal threads of the rings, which sometimes has the effect either of preventing the sensor from being screwed in or, on the other hand, of preventing the sensor from being unscrewed. In addition, these deformations affect the leak-tightness of the assembly and therefore cause burned gases to leak out or, depending on the operating point of the engine, even air to be sucked in, which proves particularly detrimental to the quality of the measurements, especially when the sensor is an oxygen sensor.

SUMMARY OF THE INVENTION

The object of the present invention is therefore an exhaust pipe provided with an internally threaded hole for housing a sensor used for analysis of the composition of the gases, this hole being made directly through the wall of the pipe itself without threaded ring attached by welding.

The exhaust device according to the invention for internal combustion engines has a pipe element inside which there flow the exhaust gases, this pipe element having a housing in which a measuring transducer such as an oxygen sensor can be mounted.

According to the invention, the exhaust device is characterized in that the housing designed for mounting of the sensor is formed by a hole prolonged by a bush made directly through the wall of the pipe element.

According to another characteristic of the exhaust device comprising an object of the invention, the pipe element in which there is formed the hole prolonged by a bush is provided with a wall of substantially uniform thickness of between 1 and 3 mm.

According to another characteristic of the exhaust device comprising an object of the invention, the pipe element in which there is formed the hole prolonged by a bush is made of stainless metal alloy.

The present invention also relates to a process for making such a housing. According to the invention, the housing made through the wall of the pipe element itself is obtained from a first flow drilling operation, which comprises drilling through the wall with a tool, a speed and a penetration force adapted to cause melting and upsetting of the material around the tool in proportion to the advance of this tool, until a bush of required height and diameter is obtained.

According to another characteristic of the working process comprising an object of the invention, the tool used for the flow-drilling operation comprises an ogival mandrel.

According to another characteristic of the working process comprising an object of the invention, the first flow-drilling operation is then followed by a second operation of thread tapping by deformation.

BRIEF DESCRIPTION OF THE DRAWINGS

The objectives, aspects and advantages of the present invention will be better understood on the basis of the description given hereinafter of a non-limitative practical example of the invention with reference to the attached drawings, wherein.

DETAILED DESCRIPTION OF THE PREFERRED EMBODIMENT

According to the figures, only the component parts necessary for understanding of the invention have been shown. In addition, to simplify reading of the drawings, like elements are designated by like reference symbols from one figure to another.

Figure 1:
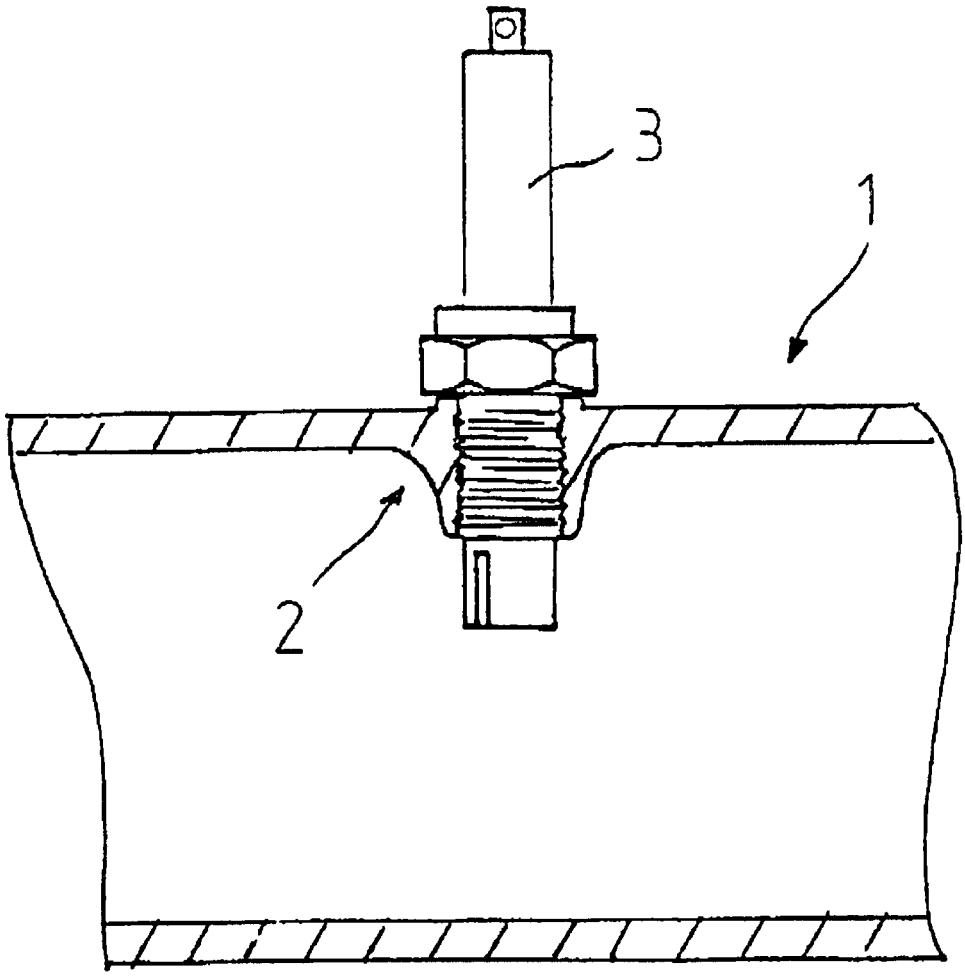
FIG. 1 is a view in partial axial section of an exhaust pipe according to the invention equipped with a measuring sensor.

Referring to FIG. 1, there is shown an exhaust pipe element designated as 1 provided on an exhaust line of an internal combustion engine mounted, for example, on a motor vehicle. This pipe, which is formed by a simple tube of stainless metal alloy with slight thickness (standard steel or aluminum-clad steel) of between 1 and 3 mm, and which is designed, for example, to extend into the exhaust manifold and the catalytic converter, which are not illustrated, is equipped with a housing 2 for a measuring sensor 3, such as a lambda oxygen sensor.

Figure 2:
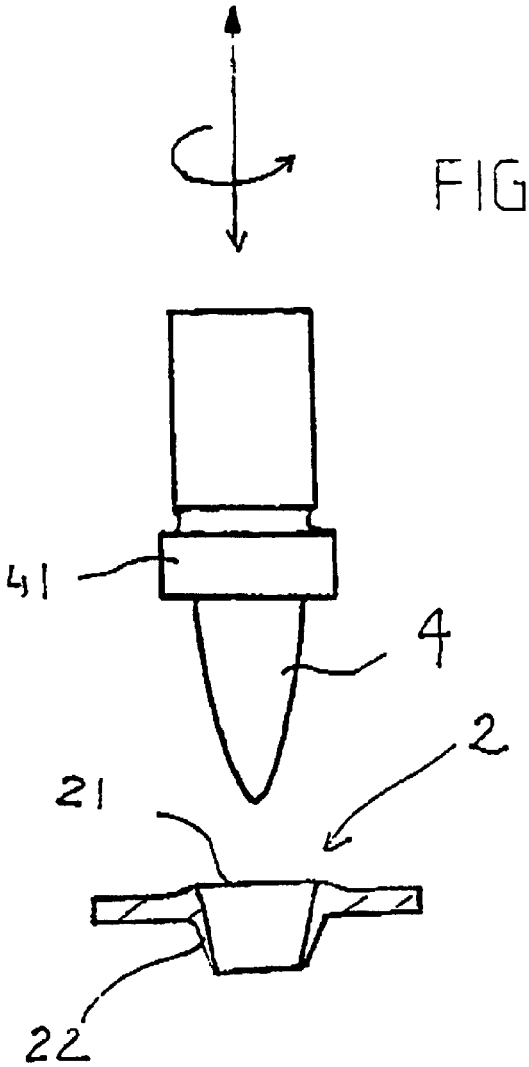
FIGS. 2 and 3 are detail views of the pipe according to FIG. 1, precisely indicating the process for making the housing of the sensor.
Figure 3:
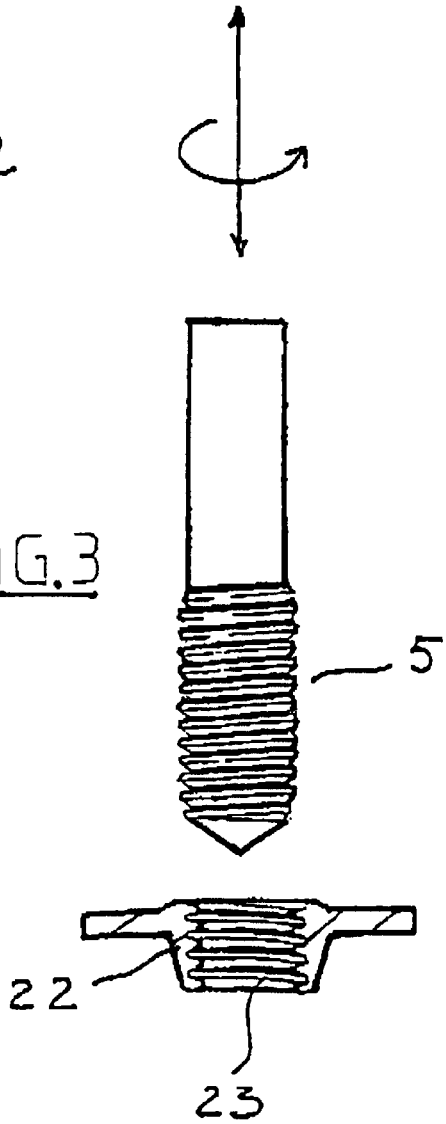

Housing 2 is made directly through the wall of the tube itself, by virtue of the process described according to FIGS. 2 and 3.

According to FIG. 2, the first operation comprises machining, by means of flow drilling, a hole 21 prolonged by a bush 22. This hole 21 and this bush 22 are obtained by drilling the wall of the tube with an ogival mandrel or punch 4, of tungsten carbide, for example, turning at high speed, in excess of 500 rpm and preferably between 3000 and 5000 rpm, and driven into the tube with a certain penetration force.

The contact of the rapidly rotating tip produces a large local temperature rise, which transforms the metal to the plastic state. The thrust exerted via the punch by the feed system causes it to penetrate progressively into the hole thus roughed out while upsetting the material around it. The metal flowing in the feed direction forms a neck and that flowing in reverse direction forms a flange. A collar 41 situated on the upper part of the punch can turn down the metal flowing back at the outside of the tube, thus giving it a plane surface which facilitates support and leaktightness of sensor 3.

In this way an accurately sized hole 21 prolonged by a bush 22 is obtained in a few seconds. In this bush 22 it is then possible to form a thread to permit sensor 3 to be screwed in. According to FIG. 3, this second operation of forming a thread 23 is achieved by thread rolling with a tap.

This operation of chipless thread tapping comprises obtaining the thread by deformation of the material of bush 22. To do so, a tool 5 having an active surface in the form of a screw is used as the tap. The tap operates by rolling, with deformation of the material of the bush, the profile of thread 23 then being impressed by displacement of material from the root of the thread toward the crest. The speed of rotation and the force of penetration of the tap are adapted to produce the desired strength of the threads. It is possible to choose a speed of rotation of the tap ranging preferably between 700 and 1500 rpm, but this is not limitative with respect to the present invention.

Thus, in two relatively simple operations which can be achieved rapidly, it is possible to make an internally threaded housing 2 directly in the wall of exhaust pipe 1 itself, in a manner which is substantially simpler than the prior art, which effectively comprises drilling the exhaust pipe or cutting it by stamping, trimming this orifice, making a machined sensor support from stainless steel, welding this support onto the pipe, and finally flushing to evacuate the metal particles produced by the preceding operations.

Thus, independently of the advantages in the quality of threading achieved by virtue of the invention compared with the prior art of an attached and welded ring or insert, the present invention offers the additional advantage of being more economical and simpler to use.

Of course, the invention is not limited merely to the described and illustrated embodiment, which was given only by way of example. To the contrary, the invention comprises all techniques equivalent to the described means as well as combinations thereof if they are performed according to the spirit of the invention.

Thus the present invention is not limited solely to making an internally threaded hole for the housing of an oxygen sensor, but it can be applied for making all internally threaded holes machined in the exhaust line of an internal combustion engine and necessary for installation of the different transducers or sensors required for control of the engine and/or for diagnostic evaluation of the device or devices provided in the exhaust line for treatment of the burned gases by catalytic conversion. Similarly, the present invention is also applicable to exhaust pipes having a plurality of concentric walls. In this case, the internally threaded hole necessary for mounting the transducer is made by performing flow drilling through the different walls.

What is claimed is:

1. An exhaust device for an internal combustion engine, said exhaust device comprising: a measuring transducer configured to analyze a flow of exhaust gases from the engine; and a pipe element adapted to carry the flow of exhaust gases from the engine, said pipe element having an integral housing in which said measuring transducer is mounted, said housing having a threaded hole extending through a bush extending only through a wall of said pipe element, said bush having an interior portion and an exterior portion, said interior portion extending further within an interior of said pipe element than said exterior portion extends beyond an exterior of said pipe element.

2. The exhaust device according to claim 1, wherein said wall of said pipe element has a substantially uniform thickness of between 1 mm and 3 mm.

3. The exhaust device according to claim 2, wherein said wall of said pipe element is made of a stainless metal alloy.

4. The exhaust device according to claim 1, wherein said wall of said pipe element is made of a stainless metal alloy.

5. A process for making an exhaust device for an internal combustion engine, said process comprising the steps of:

forming an integral housing in a pipe element adapted to carry a flow of exhaust gases from the engine, the housing being formed from a flow-drilling operation comprising drilling through only a wall of the pipe element with a tool at a speed and a penetration force adapted to cause melting and upsetting of a material of the wall around the tool in proportion to an advance of this tool until a bush of required height and diameter is obtained, wherein the bush has an interior portion and an exterior portion, the interior portion extending further within an interior of the pipe element than the exterior portion extends beyond an exterior of the pipe element;

tapping a hole through the bush to form internal threads in the hole; and mounting within the housing a measuring transducer configured to analyze a flow of exhaust gases from the engine.

6. The process according to claim 5, wherein the tool is an ogival mandrel.

7. The process according to claim 5, wherein the wall of the pipe element has a substantially uniform thickness of between 1 mm and 3 mm.

8. The process according to claim 5, wherein the wall of the pipe element is made of a stainless metal alloy.

9. The process according to claim 5, wherein the speed of the tool is greater than 500 rpms.

10. The process according to claim 9, wherein the speed of the tool is between 3000 rpms and 5000 rpms.

* * * * *